US005353689A

United States Patent [19]

Bolt et al.

[11] Patent Number: 5,353,689

[45] Date of Patent: Oct. 11, 1994

[54] IMPACT DAMPING MEANS FOR POWER CYLINDERS

[75] Inventors: David J. Bolt, West Alexandria, Ohio; Ray H. Herner, Alpena, Mich.

[73] Assignee: Mosier Industries, Inc., Brookville, Ohio

[21] Appl. No.: 86,733

[22] Filed: Jul. 2, 1993

Related U.S. Application Data

[63] Continuation-in-part of Ser. No. 912,299, Jul. 13, 1992, Pat. No. 5,224,413.

[51] Int. Cl.[5] ..... F01B 11/02

[52] U.S. Cl. ..... 92/85 R; 92/240; 188/322.18

[58] Field of Search ..... 92/7, 85 R, 84, 240; 188/322.18, 322.19, 322.22

[56] References Cited

U.S. PATENT DOCUMENTS

| | | | |
|---|---|---|---|
| 2,981,232 | 4/1961 | Peras . | |
| 2,984,529 | 5/1961 | Dailey . | |
| 3,465,650 | 9/1969 | Gluck | 92/85 R |
| 3,807,281 | 4/1974 | Perkins | 91/418 |
| 3,913,460 | 10/1975 | Wright | 92/85 R |
| 3,969,045 | 7/1976 | Sakai et al. . | |
| 3,969,986 | 7/1976 | Ohrberg . | |
| 4,050,505 | 9/1977 | Kemper et al. . | |
| 4,145,057 | 3/1979 | Wheeler . | |
| 4,441,644 | 4/1984 | Farian . | |
| 4,521,027 | 6/1985 | Marshall . | |
| 4,609,135 | 9/1986 | Elliesen . | |
| 4,618,154 | 10/1986 | Freudenthal . | |

FOREIGN PATENT DOCUMENTS

| | | | |
|---|---|---|---|
| 602412 | 2/1960 | Italy | 92/85 R |

*Primary Examiner*—Thomas E. Denion
*Attorney, Agent, or Firm*—Biebel & French

[57] ABSTRACT

An impact damping element is provided including an annular bumper portion and a seal portion surrounding the bumper portion for engaging an inner wall of a cylinder in sealing contact. The impact damping element is adapted to absorb the impact between a piston and the end of a cylinder wall. In one embodiment of the invention, a primary and a secondary bumper are provided wherein the primary bumper has a greater height than the secondary bumper such that the primary bumper absorbs an initial impact between the piston and the cylinder wall and the secondary bumper absorbs the remaining force to prevent direct contact between the piston and the cylinder wall. In an alternative embodiment of the invention, the bumper portion is formed to have different material characteristics than the seal portion whereby the bumper portion is particularly adapted to absorb impact energy and the seal portion is particularly adapted to exhibit low friction characteristics and have a high resistance to abrasion resulting from contact with the inner cylinder wall. The materials forming the seal portion and the bumper portion are preferably co-molded together such that the impact element is formed as an integral unit.

22 Claims, 4 Drawing Sheets

IMPACT DAMPING MEANS FOR POWER CYLINDERS

CROSS-REFERENCE TO RELATED APPLICATION

This application is a continuation-in-part of co-owned U.S. application Ser. No. 07/912,299, filed Jul. 13, 1992, now U.S. Pat. No. 5,224,413.

BACKGROUND OF THE INVENTION

This invention relates to a damping or absorbing element for absorbing the impact of pistons upon the ends of a power cylinder. More specifically, this invention relates to an impact damping element positioned on the ends of the cylinder or the facing surfaces of the piston for absorbing the impact of the piston against the cylinder end and preventing the piston from directly engaging the ends of the cylinder.

Generally, there are various types of impact elements used to dampen the impact of a piston against the ends of a cylinder at the end of each piston stroke in order to reduce the noise which may result from metal-to-metal contact as the piston engages the cylinder ends. U.S. Pat. No. 3,913,460, assigned to the assignee of the present invention, discloses a damping or cushioning piston impact element in the form of a contoured impact ring. The ring incorporates a resilient bumper portion and a resilient sealing lip. The sealing lip entraps the cylinder fluid between the piston and the cylinder end at the end of the piston stroke to provide an initial slowing of the piston as the piston approaches the end of the cylinder.

The main impact damping effects of the impact element described in the '460 patent are performed by the bumper portion of the impact ring. As the piston moves into close proximity to one of the cylinder end walls, the bumper portion is compressed between the piston and the cylinder end wall such that the bumper portion absorbs the energy of the impact. The bumper is designed such that under normal operating conditions, the piston will not engage the cylinder end.

As the velocity of the piston within the cylinder is increased or the weight of any element actuated by the piston is increased, resulting in increased kinetic energy, the load exerted on the bumper portion will also increase such that under certain extreme operating conditions, the bumper portion may compress sufficiently to permit metal-to-metal contact between the piston and the cylinder end. This contact between the piston and cylinder typically produces undesirable noise which the impact damping element is intended to prevent.

Conventional bumpers, such as the one described in the above referenced U.S. patent, are typically formed of a single homogeneous material such that the material characteristics of the sealing lip are the same as the material characteristics of the resilient bumper portion. Unfortunately, the material characteristics which are desirable for a sealing lip are not identical to those which are desirable for the bumper portion and a compromise must be made in selecting a material to perform both functions. For example, it is desirable to have a seal lip material which evidences low friction characteristics and a resistance to abrasion, and it is desirable to have a bumper portion material which evidences good characteristics for minimizing impact forces.

Accordingly, there is a need for an impact damping element which provides increased protection against contact between the piston and the cylinder end in the event that large loads are applied to the piston. In addition, there is a need for an impact element capable of absorbing increased loads and which retains the initial deceleration characteristics of prior art impact absorbing elements while also providing a sealing lip element which is resistant to abrasion.

SUMMARY OF THE INVENTION

The present invention provides an improved impact damping element for use with a power cylinder. Such a power cylinder includes a cylinder housing having first and second end faces and a piston having first and second end surfaces moveable between the end faces of the cylinder. The impact damping element forms an impact-absorbing cushion between the end surfaces of the piston and the end faces of the cylinder.

In a first embodiment of the invention, the impact damping element has a body portion which defines a facing surface. A primary bumper extends from the facing surface of the body portion a first distance in a direction substantially perpendicular to the facing surface of the body portion. A second bumper extends from the facing surface of the body portion a second distance which is less than the first distance of the primary bumper. The secondary bumper is substantially parallel to the primary bumper.

The primary and secondary bumpers are formed to absorb the impact and prevent contact between the end surface of the piston and the end face of the cylinder at the end of each stroke of the piston.

In a second embodiment of the invention, an impact damping element is provided having a bumper portion for engaging one of the end faces of the cylinder . and a seal portion for extending around the periphery of the piston and engaging a wall of the cylinder in sealing contact. The bumper portion and the seal portion are formed integrally with each other and have different material characteristics.

The material of the bumper portion is selected such that it has good rebound characteristics as well as the ability to dissipate energy whereby the bumper portion is able to absorb the impact force while also having sufficient resilience to be restored to its initial shape when the force is removed. The material of the seal portion is selected such that it exhibits low friction characteristics and is resistant to abrasion during reciprocating movement in contact with the cylinder wall.

It is therefore a general object of the present invention to provide an impact damping element which prevents the end surface of the piston in a power cylinder from directly impacting the end face of the cylinder.

It is another object of the invention to provide an impact damping element having a bumper portion and a seal portion wherein the material characteristics for each of the bumper and seal portions is optimized without compromising the performance of either portion.

Other objects and advantages of the present invention will be apparent from the following description, the accompanying drawings and the appended claims.

DETAILED DESCRIPTION OF THE EMBODIMENTS

Figure 1:
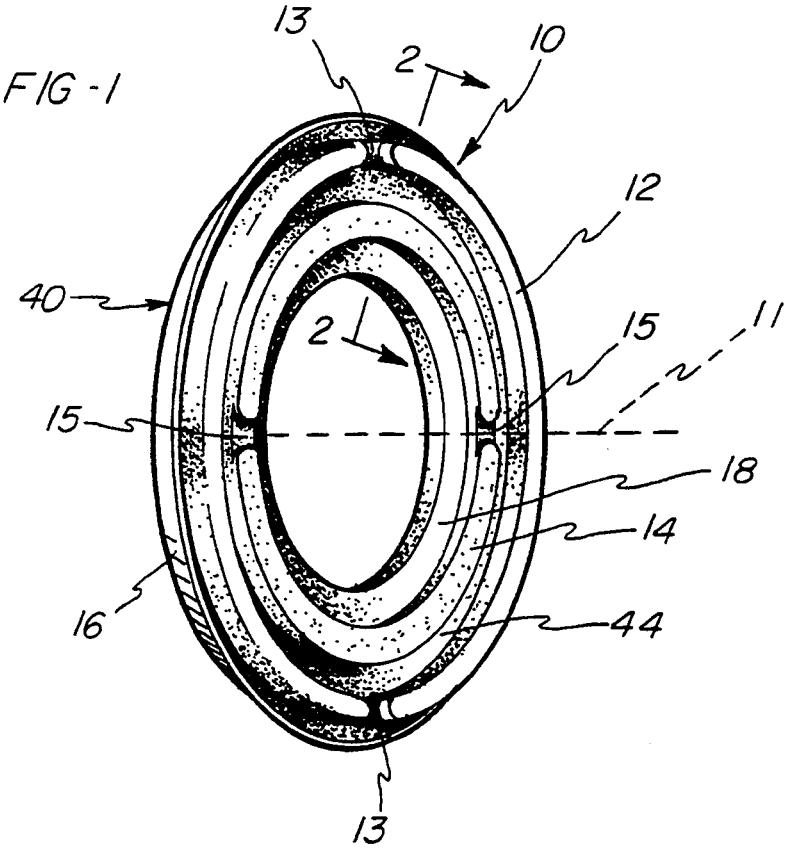
FIG. 1 is a perspective view of an impact damping ring of the present invention.
Figure 2:
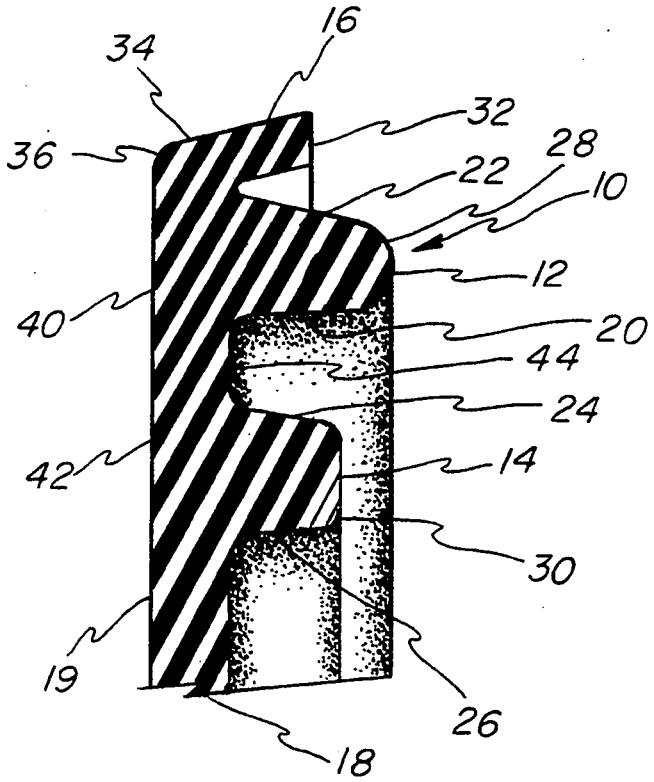
FIG. 2 is a cross-sectional view of the impact damping ring of FIG. 1 taken along line 2—2.

An impact damping ring in accordance with the present invention is shown in FIGS. 1 and 2 and is generally indicated by reference numeral 10. The impact damping ring 10 has a body portion 40 formed of resilient rubber-like material and includes a front surface 44 and a back surface 42. The impact damping ring has a generally circular shape and is formed symmetrically about a center axis 11. The back surface 42 is planar and perpendicular to center axis 11.

The impact damping ring 10 has an annular primary bumper 12 and an annular secondary bumper 14 which are concentric about the center axis 11. The primary bumper 12 includes radially inner and outer side walls 20, 22 extending in converging relation from the front face 44, and an arcuate primary engaging surface 28 extending between the side walls 20, 22. In addition, the configuration of the primary bumper 12 is such that this bumper 12 provides an initial impact damping between a cylinder and a piston moving within the cylinder such that the piston will undergo deceleration at a controlled rate. It should be noted that the primary bumper 12 may have a configuration substantially similar to the energy absorbing bumper structure disclosed in the co-owned U.S. Pat. No. 3,913,460, which patent is incorporated herein by reference.

A secondary bumper 14 extends from the front face 44 of the ring 10 in a direction parallel to the primary bumper 12. The secondary bumper 14 includes first and second side walls 24, 26 and a substantially flat secondary engaging surface 30 extending between the side walls 24, 26. The height of the secondary bumper 14, as defined by the distance of the secondary engaging surface 30 from the front face 44, is substantially less than the height of the primary bumper 12, as defined by the distance from the primary engaging surface 28 to the front face 44.

A mounting flange 18 extends radially inwardly from and perpendicular to the secondary bumper 14. The flange 18 includes a rear surface 19 coplanar with the back surface 42 of the body portion 40 and is formed to mount inside a lip on a mounting surface, which will be further discussed below.

The relative heights of the primary and secondary bumpers 12, 14 from the facing surface 44 of the body portion 40 are selected such that an initial impact and damping is performed by the primary bumper 12, and a secondary damping function is accomplished by the secondary bumper 14 after the primary bumper 12 has been compressed a predetermined amount. Further, it should be noted that the primary and secondary bumpers 12, 14 are provided with fluid vent passages 13, 15, respectively, such that each of the bumpers 12, 14 is divided into two semi-circular portions, although it should be noted that the bumpers 12, 14 may also be formed of more than two portions separated by a plurality of vent passages and located in a circular pattern around the body portion 40. The vent passages permit radial fluid flow across the front face 44 during compression of the bumpers 12, 14 such that any fluid pressure developed across the front face 44 is distributed substantially evenly across the face 44.

In addition, it should be noted that the secondary bumper 14 has a substantially higher modulus than the primary bumper 12, such that the final position of the piston during an impact will be maintained relatively constant under varying air pressure applied to the opposite side of the piston.

The ring 10 further includes a flexible annular seal portion 16 located adjacent the primary bumper 12 and formed as a thin skirt element as compared to the width of the primary and secondary bumpers 12, 14. The seal portion 16 flares outwardly from the front face 44 a distance less that the distance of extension of the primary and secondary bumpers 12, 14 from the body portion 40. This ensures that as the ring 10 operates to cushion the impact between a piston and the end of a cylinder, the bumpers 12, 14 will absorb the full impact load while avoiding any impacting contact with the seal portion 16.

In addition, the seal 16 includes an outer sealing surface 34 formed as an extension of an outer perimeter 36 of the body portion 40 wherein the sealing surface 34 diverges slightly from the outer perimeter. In use, the seal portion 16 forms a seal between a piston and a surrounding cylinder wall to prevent fluid from passing between an outer wall of the piston and the cylinder wall, as is more fully described in the above-noted U.S. Pat. No. 3,913,460.

Figure 3:
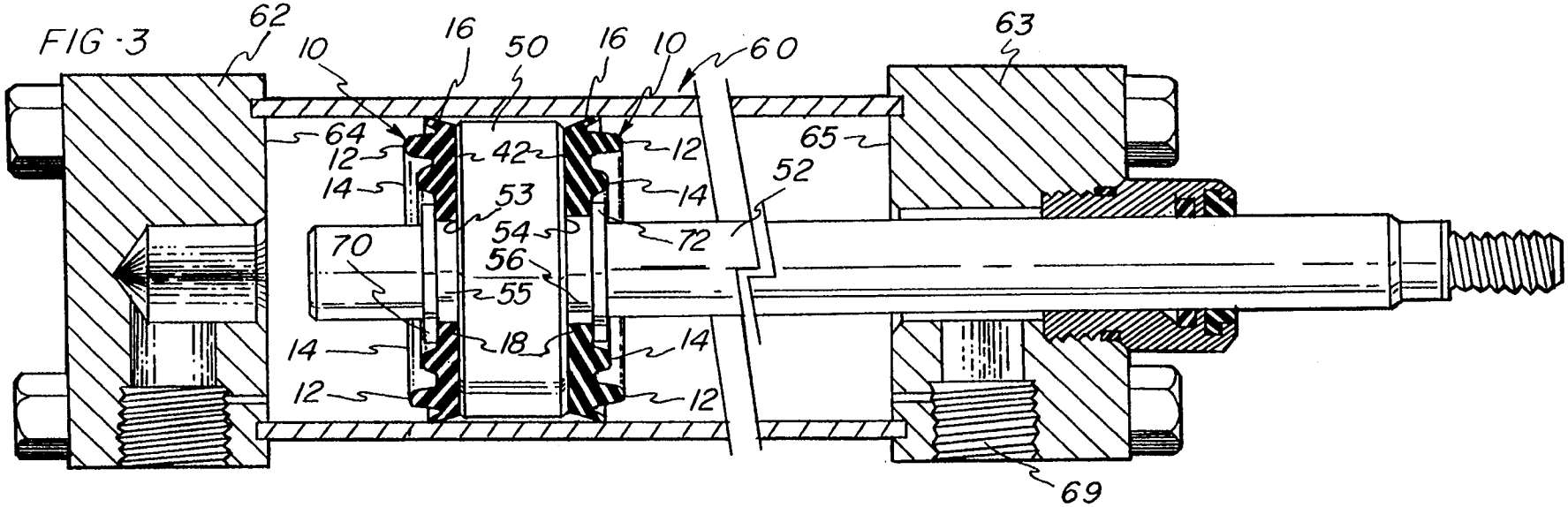
FIG. 3 is a view in axial section of a power cylinder incorporating the impact damping ring of FIG. 1 in which the cylinder housing and impact ring are shown in cross-section.
Figure 5:
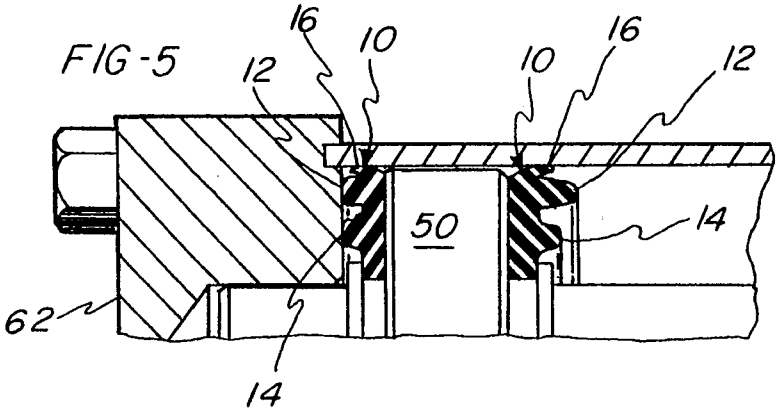
FIG. 5 is a sectional view similar to FIG. 3 with the primary and secondary bumper of the impact damping ring of FIG. 1 compressed against the cylinder end.
Figure 4:
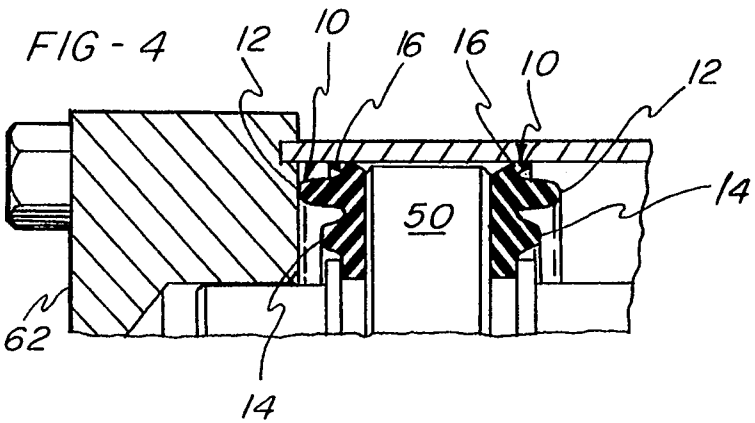
FIG. 4 is a sectional view similar to FIG. 3 with the primary bumper of the impact damping ring of FIG. 1 compressed against the end of the cylinder.

FIGS. 3-5 illustrate the impact ring 10 of the present invention in use in combination with a power cylinder including a cylinder housing 60 and a piston 50, wherein the piston 50 reciprocates between end plates 62, 63 located on opposing ends of the cylinder housing 60 and having respective end faces 64 and 65. A rod 52 may be attached to the piston 50 for reciprocating movement with the piston 50 to move an actuated element (not shown) as the power cylinder is actuated. In addition, each of the end plates 62, 63 is provided with an aperture or port 68, 69 whereby a fluid, such as a pneumatic or hydraulic fluid, fed under pressure may be supplied to the interior of the cylinder housing 60 for actuating the piston 50 in its reciprocating movement.

As seen in FIG. 3, an impact damping ring 10 is mounted to each end of the piston 50. The piston 50 has first and second end surfaces 53, 54 to which the back surfaces 42 of respective rings 10 are mounted.

Referring to FIG. 3, the piston 50 includes radially outwardly extending flanges 70, 72 spaced from respective end surfaces 53, 54. The flanges 70, 72 and end surfaces 53, 54 define recesses 55, 56 therebetween for receiving the flanges 18 of respective impact rings 10 whereby the rings 10 are held in engagement with the ends of the piston 50. With the rings 10 thus in position, the seal 16 of each of the rings 10 is located in sealing contact with the inner wall of the cylinder housing 60, and any fluid pressure applied to either end of the piston 50 will further bias the seals 16 into contact with the cylinder wall.

Referring to FIG. 4, the piston 50 is near the end of its stroke and is approaching the end face 64 of end plate 62. As the primary bumper 12 of the impact damping ring 10 engages the end face 64 of the end plate 62, the primary bumper 12 is compressed and absorbs the impact of the piston against the end plate 62. The impact damping ring 10 is designed such that during the impacting and compressing of the primary bumper 12 against the end face 64, there is sufficient space surrounding, and/or inside the bumper 12 to accommodate the portions of the primary bumper 12 deflected radially by compression against the end face 64.

In FIG. 5, the piston 50 is seen at the very end of its stroke wherein the secondary bumper 14 engages the end face 64 of the end plate 62. The secondary bumper 14 causes the deceleration of the piston 50 to occur at an increased rate compared to the primary bumper 12 due to the relatively wide engaging surface 30, as compared to the height of the bumper 14, which provides a relatively stiff impact cushioning element. In addition, the secondary bumper 14 acts in combination with the primary bumper 12 such that the movement of the piston 50 is effectively terminated before the piston 50 contacts the face surface 64. Further, it should be noted that the impact ring 10 on the opposing side of the piston operates in an identical manner as it contacts face surface 65 on end plate 63.

The configuration of the present impact ring 10 ensures that the piston 50 will decelerate at a controlled predetermined rate after contact of the primary bumper 12 with the face surface 64 while avoiding undesirable rebound effects which may result if the primary bumper 12 were stiffened to absorb all of the anticipated impact forces. The secondary bumper 14 complements the operation of the primary bumper 12 in that the secondary bumper 14 is engaged after most of the momentum force of the piston 50 has been absorbed by the primary bumper 12, and the secondary bumper 14 absorbs any residual energy of the piston 50 in order to prevent direct contact between the piston 50 and the end plate 62 at the end of the stroke.

Figure 6:
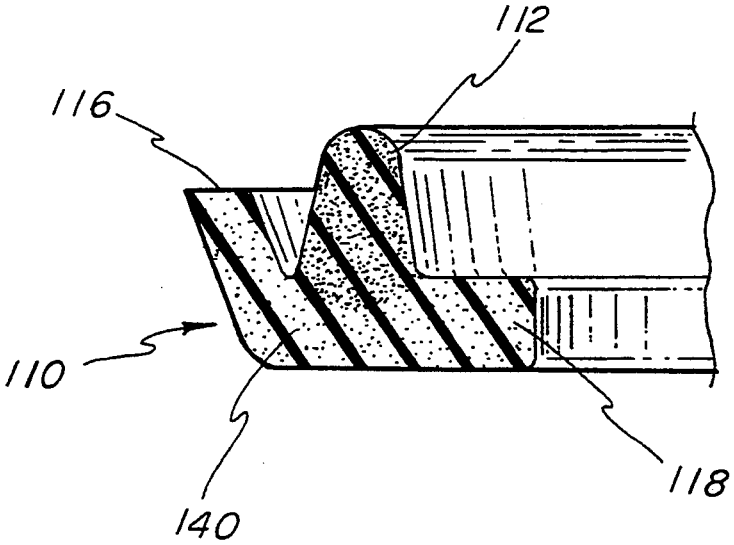
FIG. 6 is a cross-sectional view of a second embodiment of the present invention showing an impact damping element wherein a bumper portion of the element is formed of a different material than a sealing lip portion surrounding the bumper portion.

Referring to FIG. 6, a second embodiment of the present invention is provided wherein a section of an annular impact damping element 110 is shown. The impact damping element 110 of the present embodiment is shown with a single bumper portion 112 surrounded by a sealing portion or lip 116 adapted to engage an inner wall surface of a cylinder in sealing contact, as in the previous embodiment.

In the present embodiment, the bumper portion 112 is formed of a different material than the material forming the seal portion 116. As illustrated by stippling in FIG. 6, the material forming the seal 116 continues across the diaphragm to a mounting flange 118 and is blended with the material forming the bumper portion 112 in the area of the root of the bumper portion 112. The material forming the bumper portion 112 is specifically selected to absorb impacts such that the maximum force generated during impact between the piston and the cylinder wall is minimized. Thus, the ideal material for the bumper portion 112 is deformable and is capable of dissipating the kinetic energy of the piston, such as by converting the kinetic energy into heat energy and stored potential energy. Also, the material forming the bumper portion 112 must have good temperature characteristics such that its performance in absorbing impact energy is not substantially altered by any increase in temperature resulting from the conversion of kinetic energy into heat energy within the bumper portion 112. Finally, the material of the bumper portion 112 must exhibit sufficient resiliency, or rebound characteristics to restore the bumper portion 112 to its original shape after an impact. Thus, it is desirable to provide a combination of rebound and dissipation properties which together provide a minimum impact force.

Figure 9:
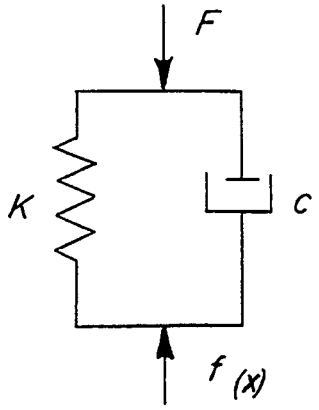
FIG. 9 is a schematic diagram illustrating the principles dictating the design of the impact damping elements of FIGS. 7-8.

FIG. 9 schematically illustrates the general principles governing the design of the bumper portion 112 wherein F denotes a force applied by the piston and k and c denote the rebound and energy dissipation characteristics, respectively, of the material for the damper portion, and f(x) denotes the resulting reaction force at the end of the cylinder. Thus, the magnitude of the force f(x) is related to the rebound or springiness k of the material as well as the damping characteristic c. It should be apparent from this diagram that in order to dissipate as much energy as possible, it is desirable to increase the value of c whereby the maximum value of f(x) is kept to a minimum, and the value of k is selected such that it is sufficient to restore the material to its original shape. In addition, it should be noted that the less the rebound characteristics of the material, the less the effect that varying air pressure within the cylinder will have on the final position of the piston during an impact. Thus, the present invention is directed toward increasing the load rating of the bumper portion without increasing the spring rate.

The ideal material for the seal portion 116 differs from the material for the bumper portion 112 in that it is desirable to have a material which has low friction and low stiction properties or characteristics for the seal 116. Further, it should be noted that these material characteristics are typically incompatible with providing the optimum material characteristics for the bumper portion 112, as described above. For example, the material characteristics of the seal portion 116 may be altered by providing this portion of the impact damping element 110 with a solid lubricant additive, such as Teflon, in order to minimize the abrasive effect resulting from contact between the seal 116 and an inner cylinder wall in contact with the seal 116. Such an additive has a detrimental effect on the memory or resilient rebound characteristics for the material which are desirable for the bumper portion 112.

In one construction of the embodiment shown in FIG. 6, the bumper portion 112 is formed of a polyurethane material and the seal portion 116 is formed of a nitrile rubber material, such as butadiene nitrile rubber, wherein the two materials are co-molded and blended together in the body portion 140 of the impact damping element 110. Thus, the bumper portion 112 and seal portion 116 are formed integrally with each other to ensure that the impact damping element 110 is configured as a durable structure which will not separate at the junction between the materials forming the bumper portion 112 and the seal portion 116. Alternatively, the entire impact damping element 110 may be formed of a common material, such as polyurethane rubber, with the material of the seal portion 116 altered through the addition of a solid lubricant additive, such as Teflon, whereby the friction effects of the seal 116 are reduced and its resistance to abrasion is increased. In addition, multiple durometer materials of similar or dissimilar materials could also make up a materially ideal combination for the present invention, as is discussed in further detail below.

Figure 7:
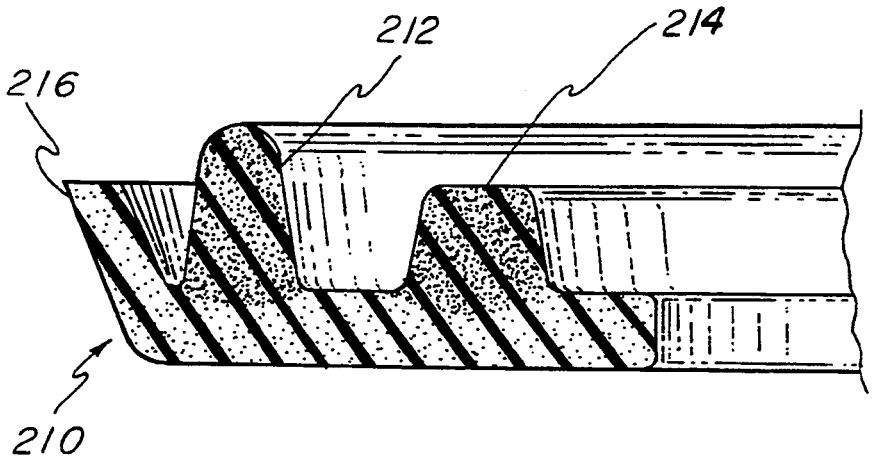
FIG. 7 is an alternative concept of the embodiment of FIG. 6 wherein a primary and secondary bumper are provided.

Referring to FIG. 7, an alternative configuration of the embodiment described in FIG. 6 is disclosed. In this embodiment, an annular impact damping element 210 is shown wherein the bumper portion includes a primary bumper 212 and a secondary bumper 214. The primary and secondary bumpers 212, 214 operate in a manner similar to that disclosed with regard to the embodiment of FIGS. 1–5. In addition, a seal portion 216 is provided surrounding the bumper portion for sealingly engaging a cylinder wall. The primary and secondary bumpers 212, 214 are constructed of a material which has different material properties or characteristics than the material of the seal portion 216, wherein the material characteristics for the bumpers 212, 214 and the seal portion 216 are selected in the same manner as described above with regard to the impact damping element of FIG. 6. Further, it should be noted that the primary and secondary bumpers 212, 214 could each be formed of a unique material different from each other and different from the seal portion 216.

Figure 8:
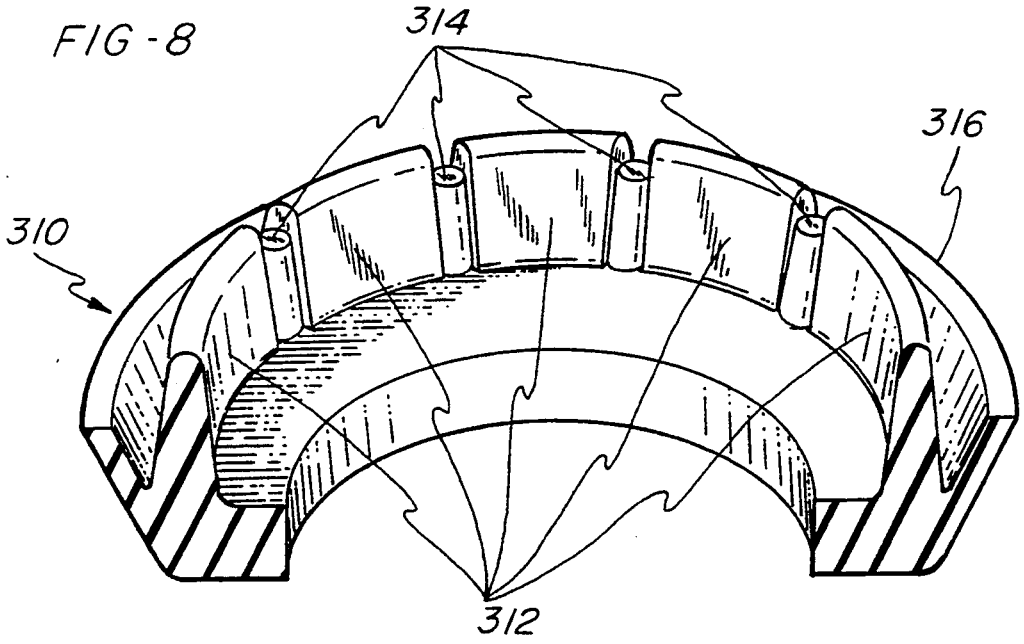
FIG. 8 is yet another embodiment wherein land portions are positioned within the bumper portion of an impact damping element and the land portions are formed of a different material than the material forming the surrounding sealing lip.

FIG. 8 illustrates yet another embodiment of the present invention wherein an annular impact damping element 310 is shown and includes primary bumper elements 312 and secondary bumper elements 314. The primary and secondary bumper elements 312, 314 are located along a common circumference of the impact damping element 310. The secondary bumper elements 314 may be formed as lands co-molded into the element 310 which are formed of a different material than the primary bumper elements 312. The primary bumper elements 312 may be formed of the same material as the seal portion 316, or alternatively, may be formed of a different material.

In an alternative construction of the embodiments of FIGS. 7–8, the impact damping element 110, 210, 310 may be formed such that the bumper portion 112, 212, 312, 314 and seal portion 116, 216, 316 are formed with multiple durometer hardnesses. For example, the bumper portion 112, 212, 312, 314 may be formed with a different shore A durometer hardness than the seal portion 116, 216, 316. Further, the bumper portion 112, 212, 312, 314 and the seal portion 116, 216, 316 may be formed of the same material or of different materials. Altering the durometer hardness of the material will have a direct effect on the rebound characteristics of the material such that the rebound characteristics of the bumper portion 112, 212, 312, 314 may be controlled substantially independently of the rebound characteristics of the seal portion 116, 216, 316.

It should be apparent from the description of the embodiments of FIGS. 7–8, that the present invention provides for maximum energy dissipation within the bumper portion to minimize the transmitted force between a piston and a cylinder end. Further, the material for the seal portion of these impact damping elements is maximized independently of the material selected for the bumper portion. In addition, by providing a bumper portion which is formed of a material ideally suited to dissipating impact energy, it is possible to form the impact damping element as a compact member particularly adapted to be used in small power cylinders.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An impact damping element for use with a power cylinder having a piston positioned for reciprocating movement within a cylinder having opposing cylinder ends, said element being adapted to be mounted within said cylinder to cushion impact forces between said piston and said cylinder ends, said element comprising:

a bumper portion for forming a cushioning element between said piston and one of said cylinder ends;

a seal portion for engaging a surface of said power cylinder in sliding and sealing contact; and wherein said bumper portion and said seal portion are formed integrally with each other and the material properties of said bumper portion are different from the material properties of said seal portion.

2. The element as in claim 1 wherein said bumper portion and said seal portion are formed of different materials.

3. The element as in claim 2 wherein said material forming said bumper portion is blended into said material forming said seal portion.

4. The element as in claim 2 wherein said bumper portion is formed of polyurethane and said seal portion is formed of a nitrile rubber.

5. The element as in claim 1 wherein the material forming said bumper portion has greater rebound characteristics than the material forming said seal portion.

6. The element as in claim 1 wherein the material forming said bumper portion has a greater capacity for dissipating impact energy than the material forming said seal portion.

7. The element as in claim 1 wherein said bumper portion and said seal portion are formed of a common material and said seal portion includes a friction reducing additive not present in said bumper portion.

8. The element as in claim 16 wherein said bumper portion and said seal portion are formed as annular members and said element includes a flange portion extending radially inwardly for mounting said element to said piston.

9. The element as in claim 1 wherein said bumper portion includes a primary annular member extending to a first height and a secondary annular member extending to a second height less than said first height.

10. The element as in claim 1 wherein said bumper portion is formed as an annular member of a first material extending to a first height and said bumper portion includes a second material extending to a second height less than said first height.

11. The element as in claim 10 wherein said second material is formed as discrete land members circumferentially spaced on said bumper portion.

12. The element as in claim 1 wherein said bumper portion and said seal portion have multiple durometer hardnesses.

13. The element as in claim 1 wherein said bumper portion has a different durometer hardness than said seal portion.

14. The element as in claim 13 wherein said bumper portion and said seal portion are made of the same material.

15. The element as in claim 13 wherein said bumper portion and said seal portion are made from different materials.

16. An impact damping element for use with a piston positioned for reciprocating movement within a cylinder having opposing cylinder ends, said element being adapted to be mounted within said cylinder to cushion impact forces between said piston and said cylinder ends, said element comprising:

an annular bumper portion for engaging one of said cylinder ends;

an annular seal portion located radially outwardly from said bumper portion for extending around the periphery of said piston and engaging a wall of said cylinder in sealing contact; and wherein said bumper portion and said seal portion are formed integrally with each other and have different material characteristics such that the material forming said bumper portion has a greater capacity for dissipating impact energy than the material forming said seal portion and said material forming said seal portion has lower friction and better wear characteristics than said material forming said bumper portion.

17. The element as in claim 16 wherein said material forming said bumper portion is co-molded with said material forming said seal portion such that said materials forming said bumper portion and said seal portion are blended into each other.

18. The element as in claim 17 wherein said bumper portion is formed of polyurethane and said seal portion is formed of a nitrile rubber.

19. The element as in claim 16 wherein said bumper portion and said seal portion are formed of a common material and said seal portion includes a friction reducing additive not present in said bumper portion.

20. The element as in claim 16 wherein said bumper portion has a different durometer hardness than said seal portion.

21. The element as in claim 20 wherein said bumper portion and said seal portion are made of the same material.

22. The element as in claim 20 wherein said bumper portion and said seal portion are made from different materials.

* * * * *

UNITED STATES PATENT AND TRADEMARK OFFICE

CERTIFICATE OF CORRECTION

PATENT NO. : 5,353,689

DATED : Oct. 11, 1994

INVENTOR(S) : David J. Bolt and Ray H. Herner

It is certified that error appears in the above-indentified patent and that said Letters Patent is hereby corrected as shown below:

Column 8, line 45, "16" should be --1--.

Signed and Sealed this

Thirteenth Day of December, 1994

*Attest:*

Bruce Lehman

BRUCE LEHMAN

*Attesting Officer*

*Commissioner of Patents and Trademarks*